US008096594B2

(12) United States Patent
Uyeda

(10) Patent No.: US 8,096,594 B2
(45) **Date of Patent: *Jan. 17, 2012**

(54) COMPACT ELECTRIC STRIKE WITH PRELOAD RELEASE CAPABILITY

(75) Inventor: Alan K. Uyeda, Irvine, CA (US)

(73) Assignee: Adams Rite Manufacturing Co., Pomona, CA (US)

( * ) Notice: Subject to any disclaimer, the term of this patent is extended or adjusted under 35 U.S.C. 154(b) by 926 days.

This patent is subject to a terminal disclaimer.

(21) Appl. No.: 11/906,414

(22) Filed: Oct. 3, 2007

(65) Prior Publication Data

US 2009/0056395 A1 Mar. 5, 2009

Related U.S. Application Data

(63) Continuation-in-part of application No. 11/788,873, filed on Apr. 23, 2007, now Pat. No. 7,438,335.

(51) Int. Cl.
*E05B 15/02* (2006.01)
*E05B 15/00* (2006.01)

(52) U.S. Cl. ..... 292/341.15; 292/340; 292/341.16

(58) Field of Classification Search ..... 292/340, 292/341.15, 341.16

See application file for complete search history.

(56) References Cited

U.S. PATENT DOCUMENTS

| | | | | |
|---|---|---|---|---|
| 3,640,560 | A | 2/1972 | Zawadski et al. | |
| 3,819,215 | A * | 6/1974 | Fuss | 292/201 |
| 4,211,443 | A * | 7/1980 | Butts et al. | 292/341.16 |
| 4,815,776 | A * | 3/1989 | Fuss | 292/341.16 |
| 4,917,425 | A * | 4/1990 | Logas | 292/341.16 |
| 4,986,584 | A * | 1/1991 | Logas | 292/341.16 |
| 5,042,316 | A | 8/1991 | Gressett, Jr. | |
| 5,076,625 | A | 12/1991 | Oxley | |
| 5,118,150 | A | 6/1992 | Jarrett | |
| 5,184,523 | A | 2/1993 | Nyzedatny | |
| 5,490,699 | A | 2/1996 | Uyeda | |
| 5,924,750 | A * | 7/1999 | Fuss et al. | 292/201 |
| 5,934,720 | A * | 8/1999 | Karalius | 292/341.16 |
| 6,390,520 | B1 * | 5/2002 | Holzer | 292/341.17 |
| 6,595,563 | B2 * | 7/2003 | Kiernan | 292/341.16 |
| 7,021,684 | B2 * | 4/2006 | Orbeta et al. | 292/341.16 |
| 7,101,195 | B2 | 9/2006 | Brooks | |
| 7,438,335 | B1 * | 10/2008 | Uyeda | 292/341.16 |
| 2001/0005084 | A1 | 6/2001 | Ponziani | |
| 2003/0199223 | A1 | 10/2003 | Spurr | |

* cited by examiner

*Primary Examiner* — Carlos Lugo
(74) *Attorney, Agent, or Firm* — William W. Haefliger

(57) ABSTRACT

In a door strike for captivating and releasing a door bolt, the combination comprising a longitudinally elongated carrier, a longitudinally elongated solenoid supported by the carrier, the solenoid having a longitudinally movable plunger, a trip lever pivotally supported in or on the carrier, a laterally extending actuating arm pivotally supported in or on the carrier to be pivoted as the plunger moves longitudinally in response to solenoid energization, thereby to pivot the trip lever, a generally longitudinally extending blocking arm or arms pivotally supported in or on the carrier to be released for pivoting when the trip lever is pivoted, and a door bolt retainer or retainers pivotally supported in the carrier to be released for pivoting when the blocking arm or arms are released for pivoting, thereby to release the door bolt from captivation, for movement with the door. Dual springs are compressed by the plunger in response to solenoid energization. A strut on the plunger engages solenoid structure upon plunger retraction to prevent wear or peening of the plunger.

22 Claims, 20 Drawing Sheets

101
100
10
2
12
14
13
11
4
34
34a
35a
35
16
15

(FAIL SAFE – LOCKED)

(FAIL SAFE – UNLOCKED)

(FAIL SECURE – UNLOCKED)
(POWER ON)

(FAIL SECURE – LOCKED)
(POWER OFF)

COMPACT ELECTRIC STRIKE WITH PRELOAD RELEASE CAPABILITY

BACKGROUND OF THE INVENTION

This application is a continuation-in-part of U.S. patent application Ser. No. 11,788,873, filed Apr. 23, 2007 now U.S. Pat. No. 7,438,335.

This invention relates generally to electric strikes used in connection with locking and unlocking of doors. More particularly, it concerns improvements in the construction and operation of such strikes, particularly as regards reduction in overall size while enabling programmable operation.

There is continuing need for reliable electric strikes of the above type, and characterized by long reliable life, reduction in size and enhanced efficiency. There is also need for strikes having unusual advantages in construction, in operation, and providing improved results, embodied in the present invention, as will be seen.

SUMMARY OF THE INVENTION

It is a major object of the present invention to provide an unusually advantageous electric strike meeting the above as well as additional needs. Basically, the strike construction includes:

a) a longitudinally elongated carrier, b) a longitudinally elongated solenoid supported by the carrier, the solenoid having a longitudinally movable plunger, c) a trip lever pivotally supported in the carrier, d) a laterally extending actuating arm pivotally supported in the carrier to be pivoted as the plunger moves longitudinally in response to solenoid energization, thereby to pivot the trip lever, e) a generally longitudinally extending blocking arm or arms pivotally supported in the carrier to be released for pivoting when the trip lever is pivoted, and f) a door bolt retainer or retainers pivotally supported in the carrier, to be released for pivoting when the blocking arm or arms are released for pivoting, thereby to release the door bolt from captivation, for movement with the door.

Another object is to provide for one of the following:

i) fail safe positioning in which the blocking arm or arms is or are unblocked in the event of electric power supply interruption to the solenoid, ii) fail secure positioning in which the blocking arm or arms remain blocked by the trip lever, against pivoting.

A further object includes provision of an adjustable slider movable longitudinally and having operative engagement with one of c), d), e) and f) above to provide fail safe positioning in one longitudinal position of the slider and alternatively to provide fail secure positioning in another longitudinal position of the slider.

A further object is to provide:

a) a solenoid having a longitudinally movable plunger, b) first and second spring elements located for sequentially resisting plunger axial movement, in a first longitudinal direction, whereby the first element and then the second element resist said plunger movement, c) and door locking and unlocking mechanism operatively connected to said plunger.

As will be seen, the second spring element typically has a higher spring rate than the first spring element. Also, the spring elements typically have coil configuration and are spaced apart longitudinally.

Yet another object is to provide pushers associated with the plunger to move therewith, and operable to first compress the first spring element and subsequently to compress the second spring element in response to said plunger movement. The second spring element is typically located, when compressed, to positively and rapidly urge the plunger in a second longitudinal direction opposite said first longitudinal direction when the solenoid is de-energized.

An added object is to provide a strut carried to extend at the side of the plunger for movement therewith, to engage solenoid structure in response to plunger retraction, for limiting said retraction. In this regard the strut is typically operatively connected to the plunger adjacent a cam on the plunger, the cam having two oppositely and axially tapered surfaces, said strut connected to the cam to extend adjacent said surfaces. The strut typically has an end that engages a stop surface on the solenoid, whereby the end of the plunger does not wear or peen, interfering with plunger operation.

Additional objects include provision of two blocking arms spaced apart longitudinally, one blocking arm located laterally of a casing defined by the solenoid, to pivot away from that casing, the other blocking arm located laterally of the plunger, to pivot away from the plunger. In this regard, compact location of elements is provided by positioning of the trip lever and at least one of the blocking arms laterally of and adjacent to the solenoid; and by provision of interengagement of the retainer or retainers with a blocking arm or arms, characterized as releasable when the blocking arm or arms pivot in one direction as the retainer or retainers pivot in the opposite direction.

These and other objects and advantages of the invention, as well as the details of an illustrative embodiment, will be more fully understood from the following specification and drawings, in which:

DRAWING DESCRIPTION

Figure 4:
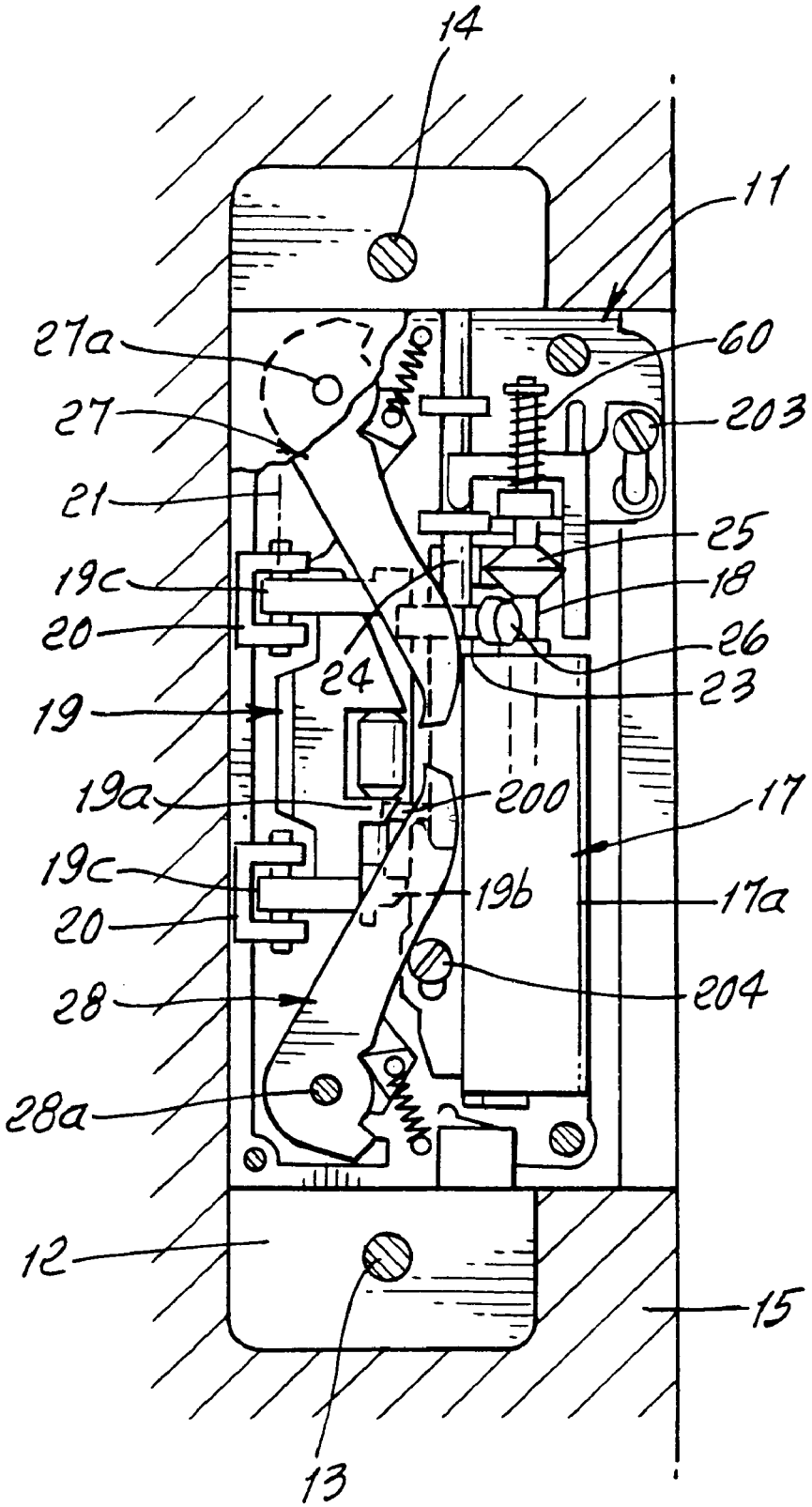
FIG. 4 is an inner side view of compact striker structure, as viewed in arrow direction 4 indicated in FIG. 1, the retainers and associated blocking arms being retracted, i.e. with blocking arms in blocking positions as determined by solenoid plunger position; and in fail secure mode.
Figure 5:
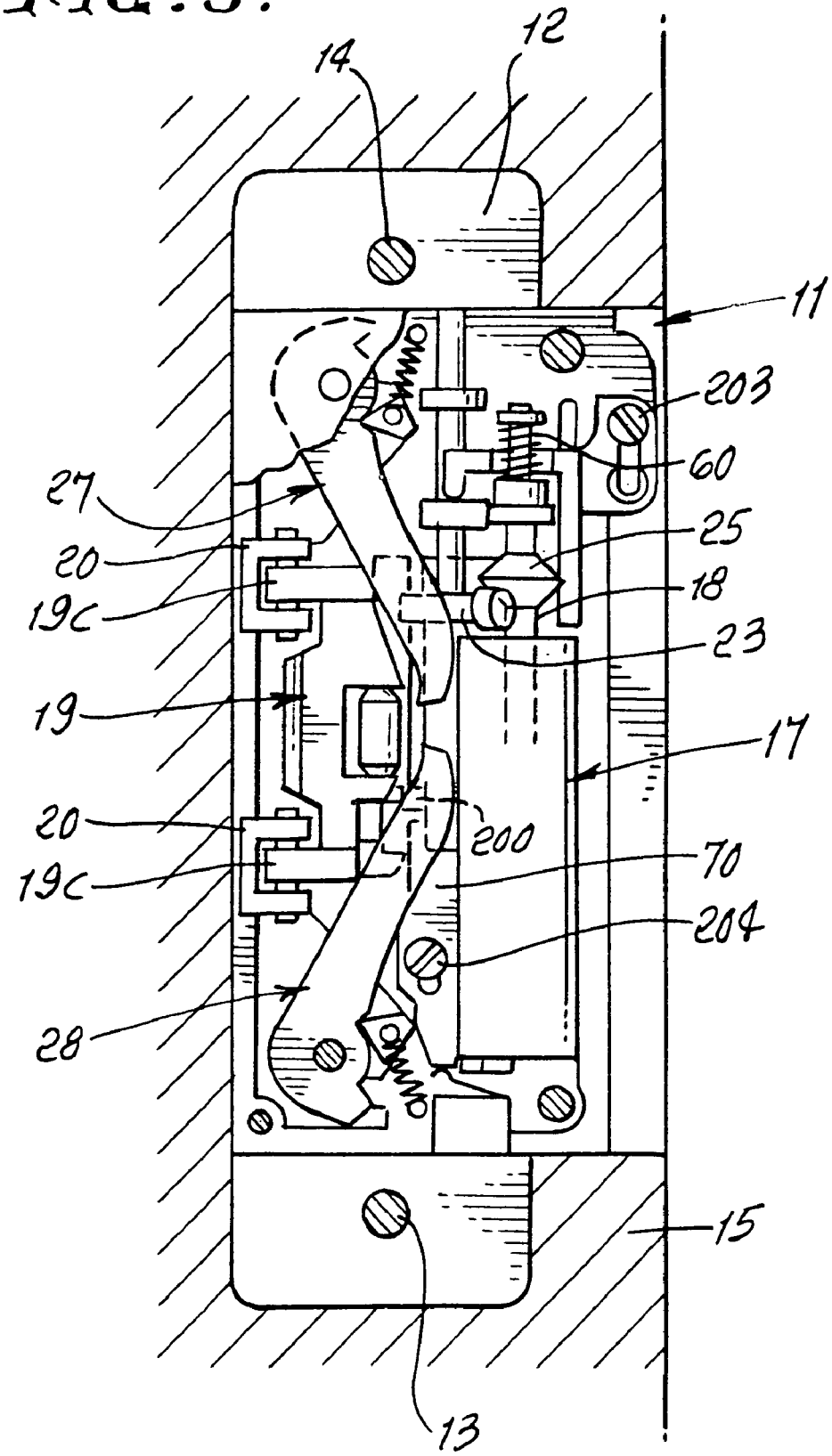
FIG. 5 is a view like FIG. 4, but with solenoid plunger in neutral position.
Figure 6:
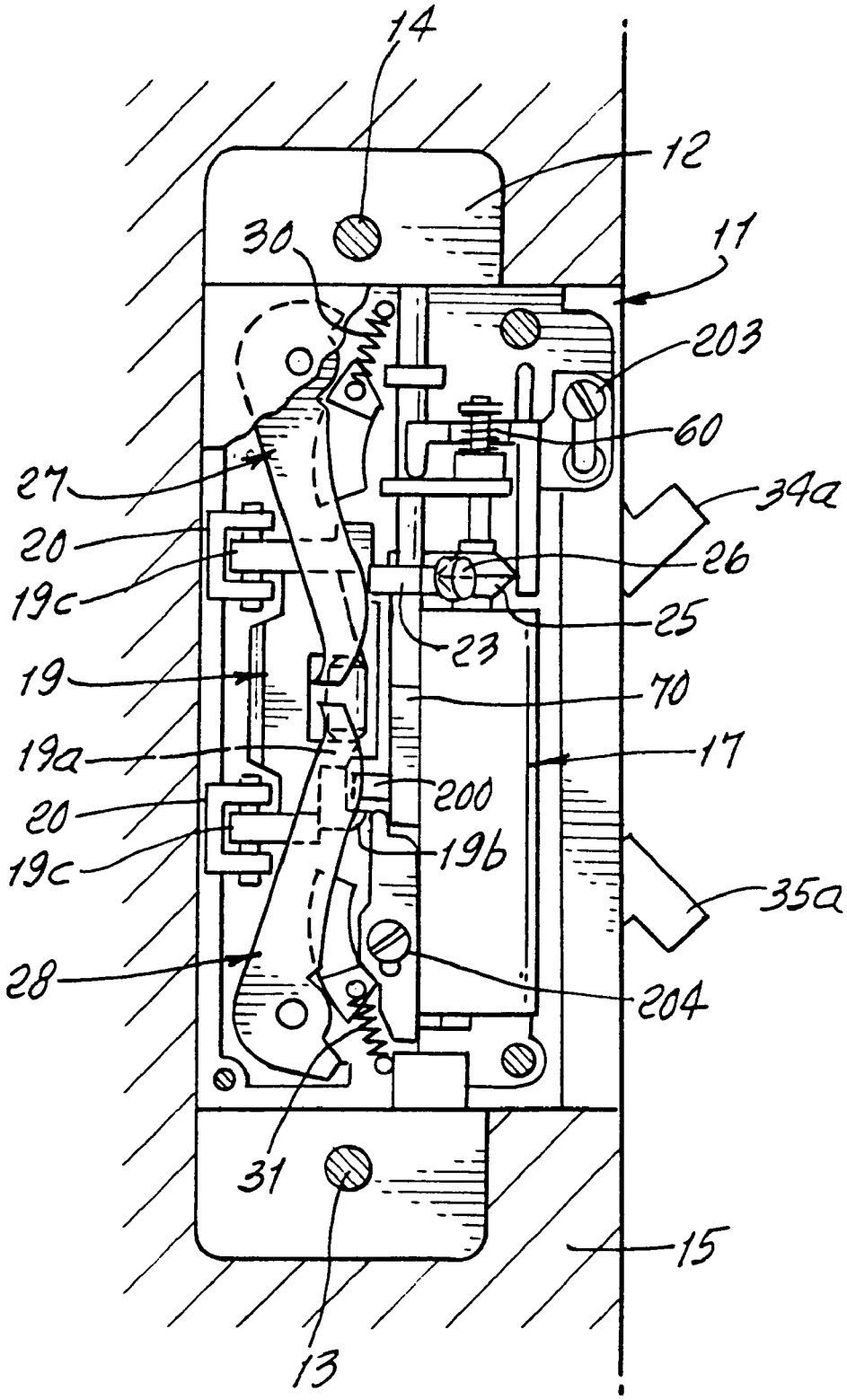
FIG. 6 is a view like FIG. 4, but with solenoid plunger in fully retracted position, and the blocking arm in unblocked position.
Figure 8:
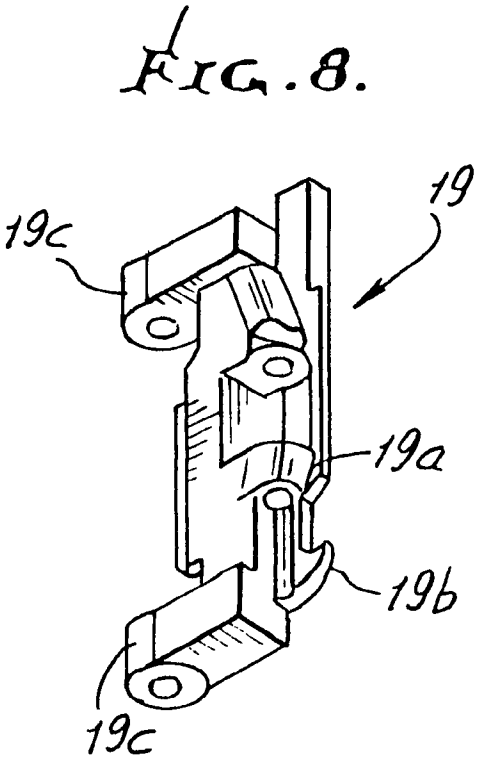
FIG. 8 is a perspective view of the trip lever as employed in FIG. 7.
Figure 7:
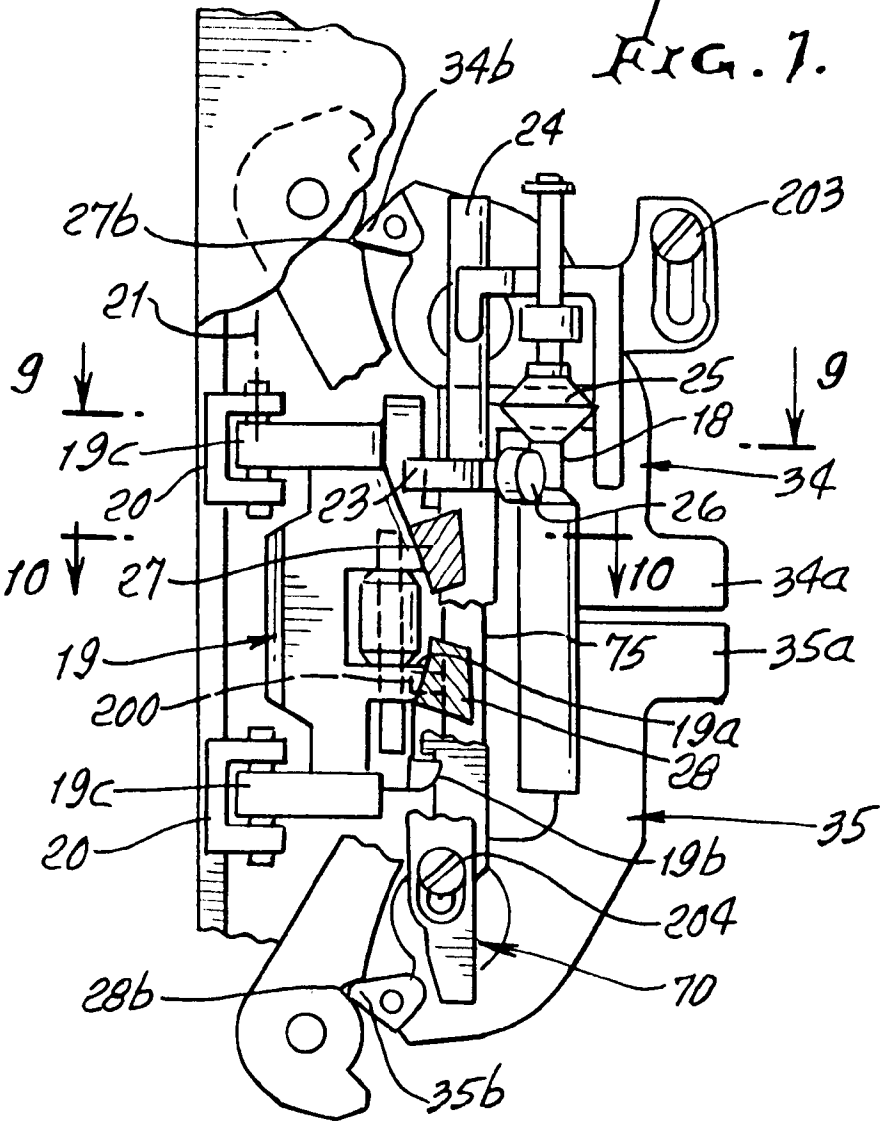
FIG. 7 is a view like FIG. 4, showing trip lever positioning in relation to blocking arm positioning.
Figure 10:
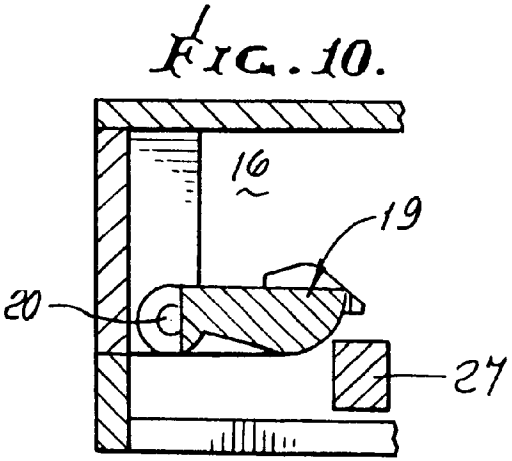
Figure 10A:
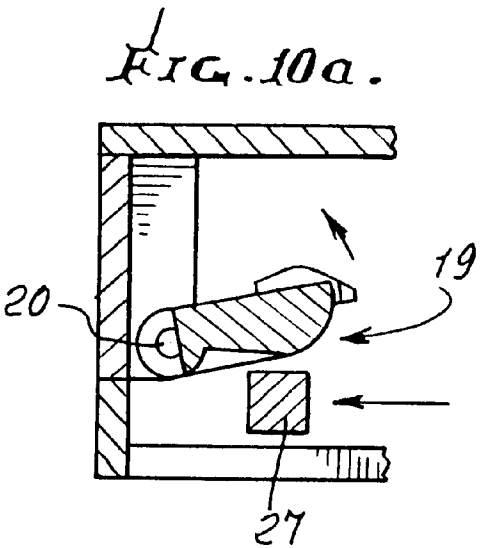
Figure 9:
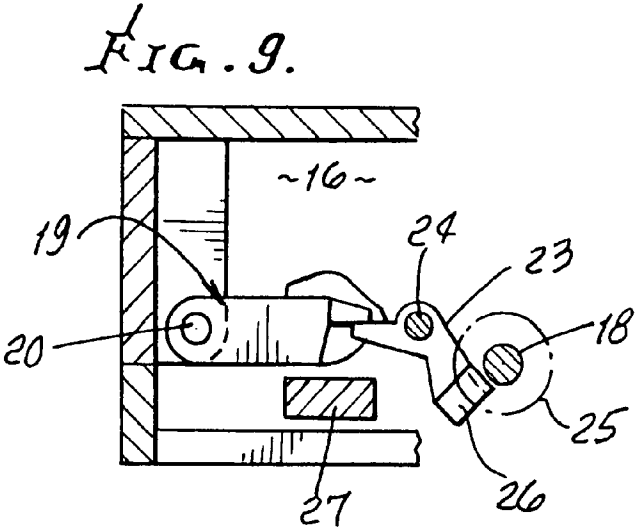
FIG. 9 is a view taken in section on lines 9-9 of FIG. 7.
Figure 9A:
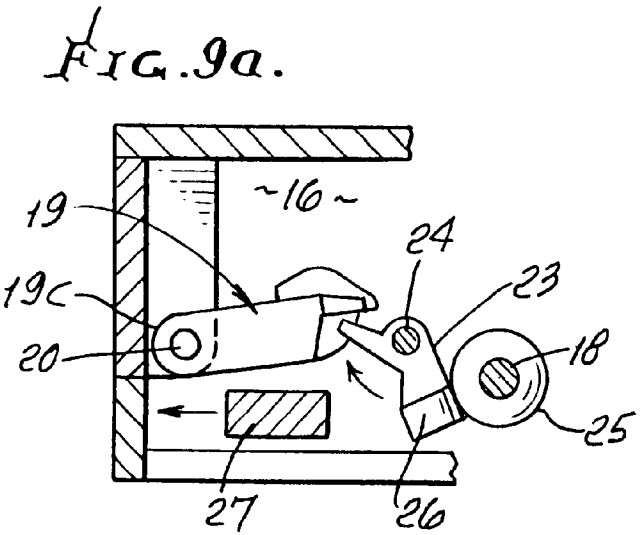
Figure 12:
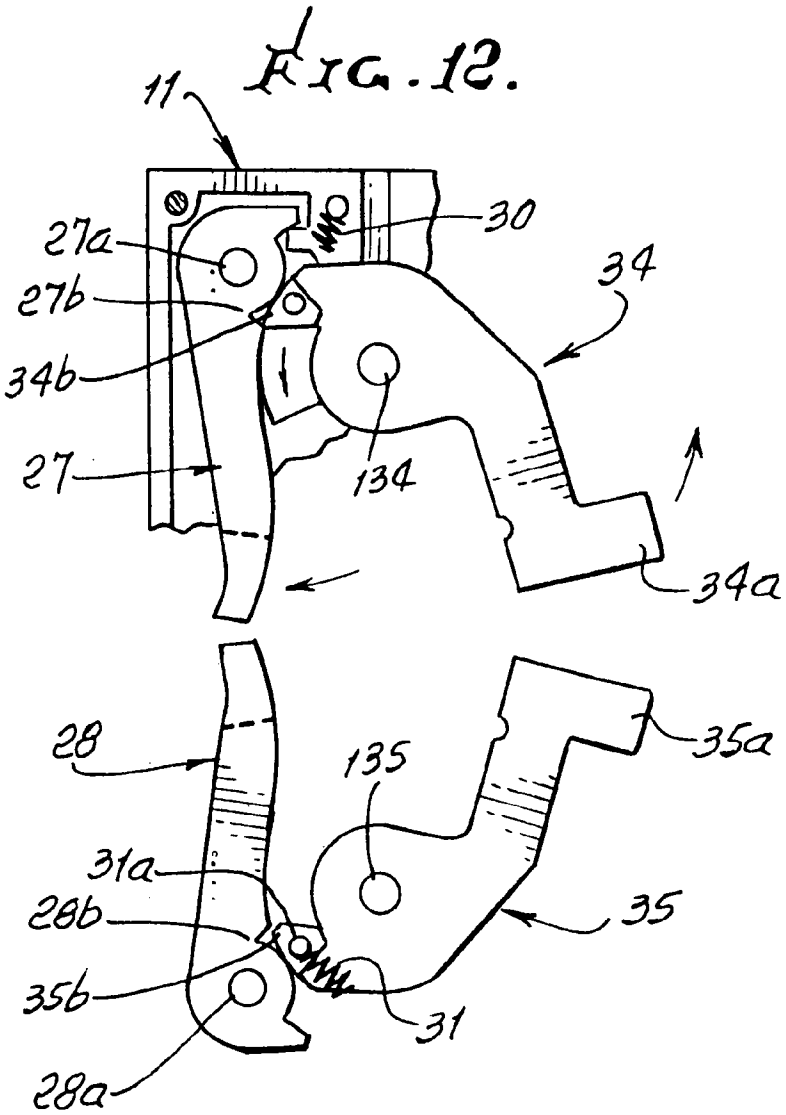
Figure 11:
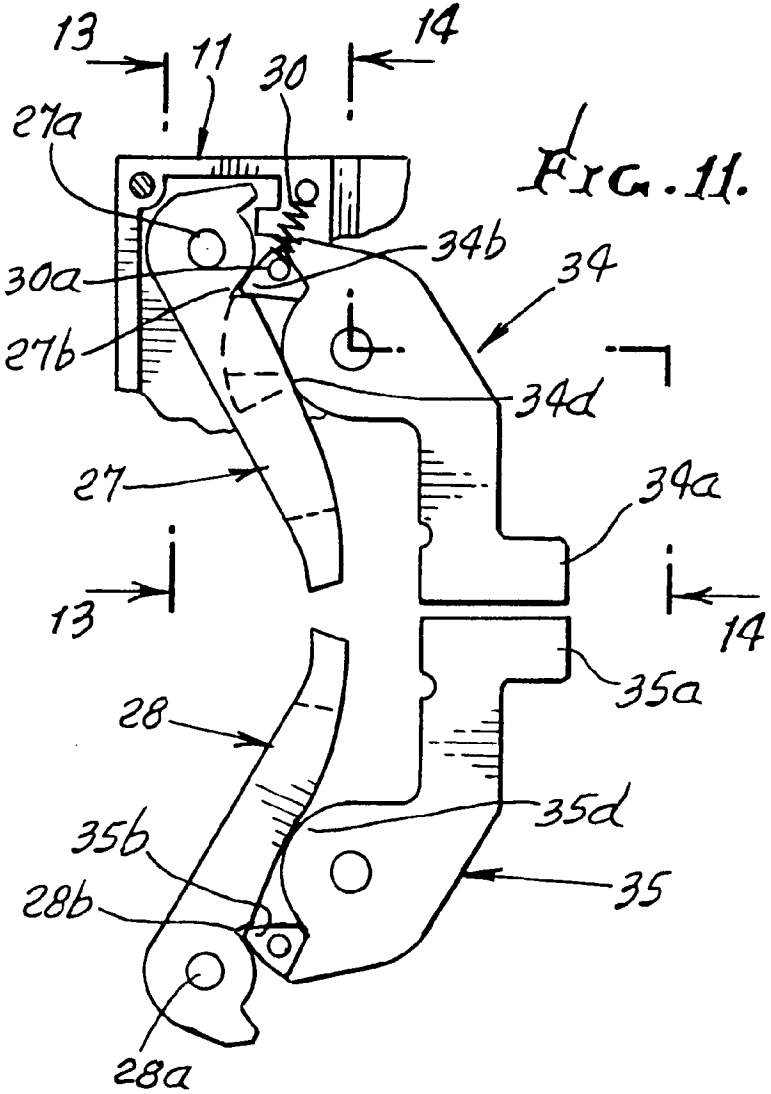
Figure 13:
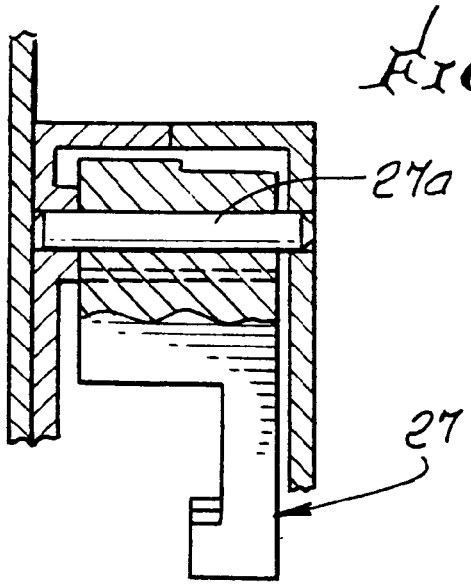
Figure 15:
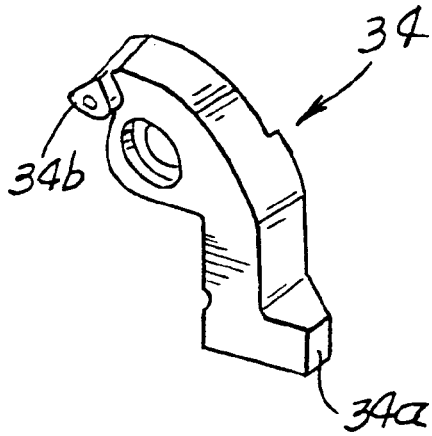
Figure 14:
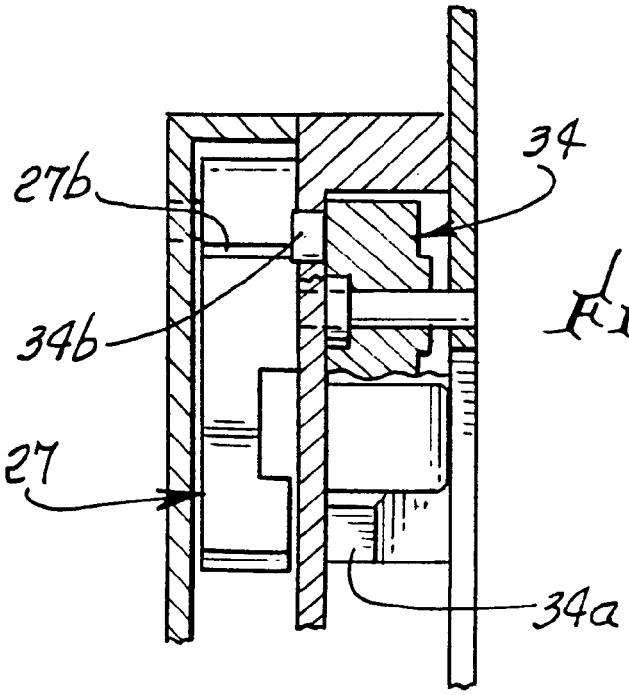
Figure 16:
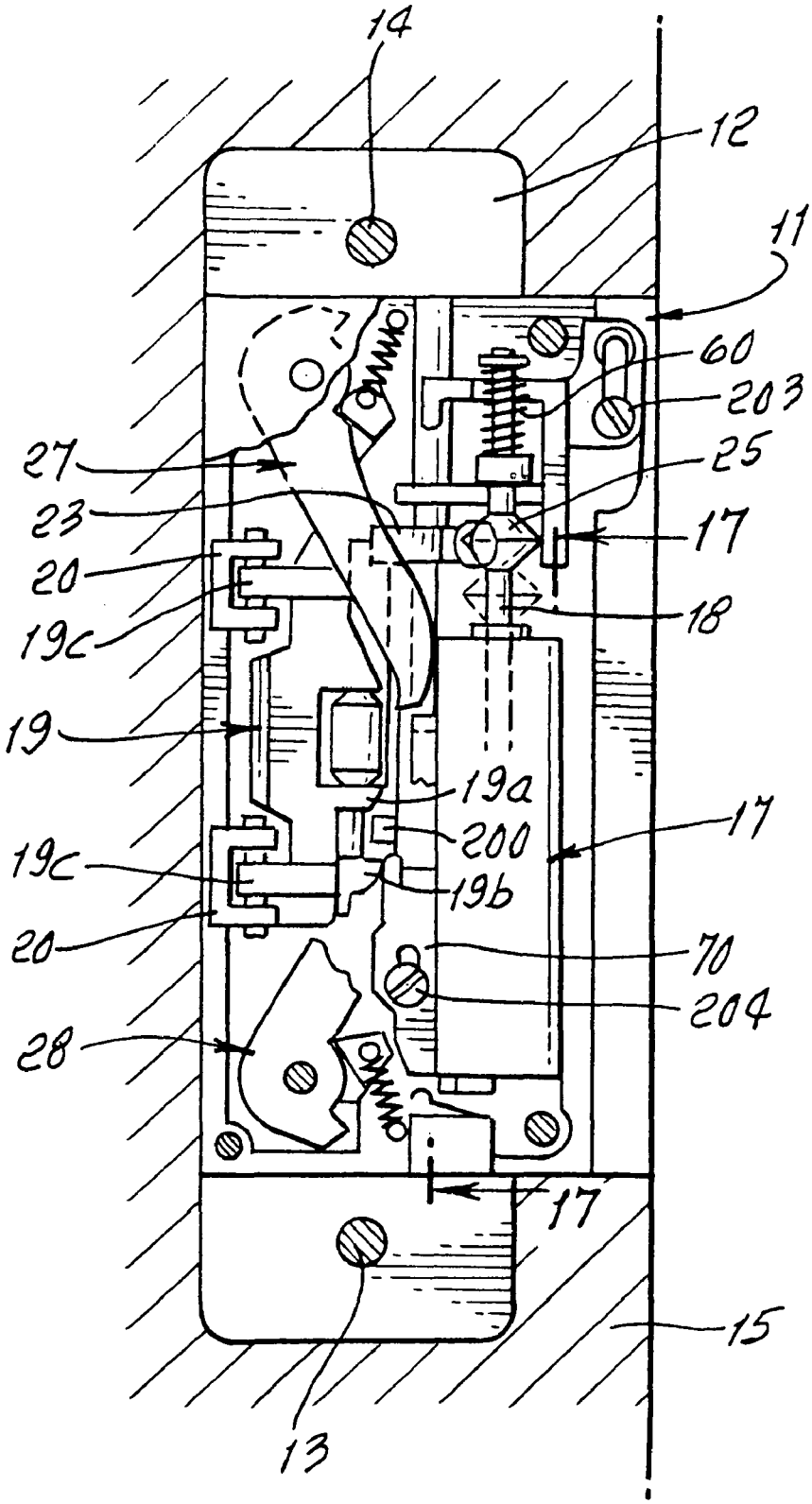
Figure 17:
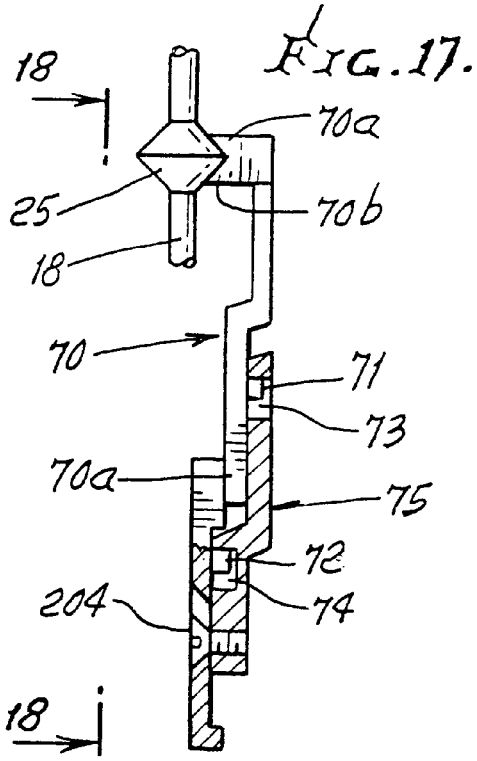
Figure 18:
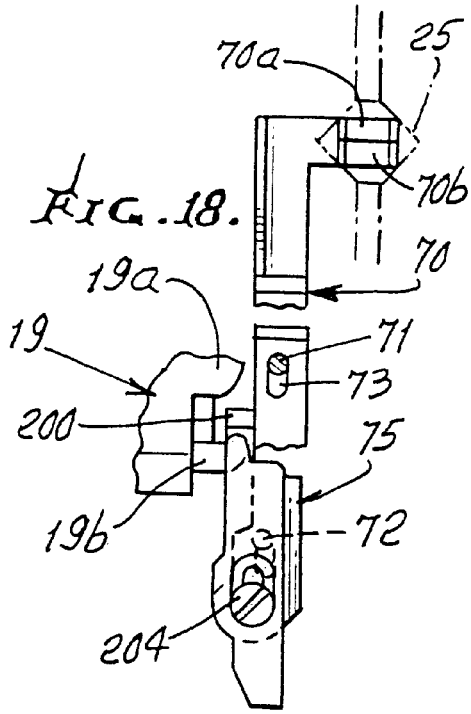
Figure 19:
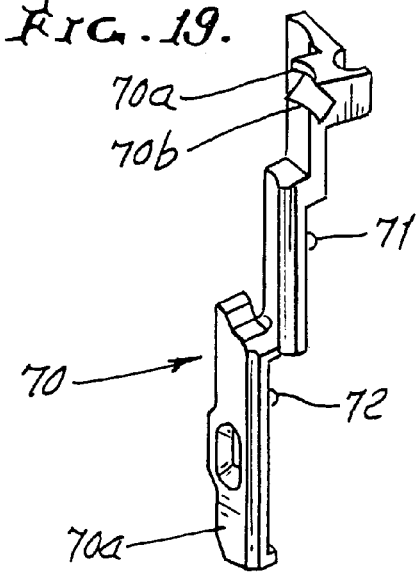
Figure 20:
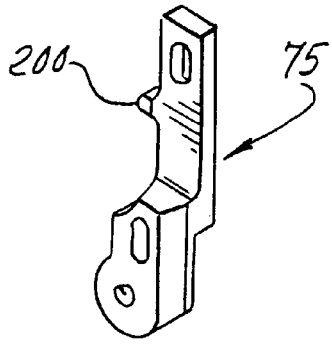
Figure 21A:
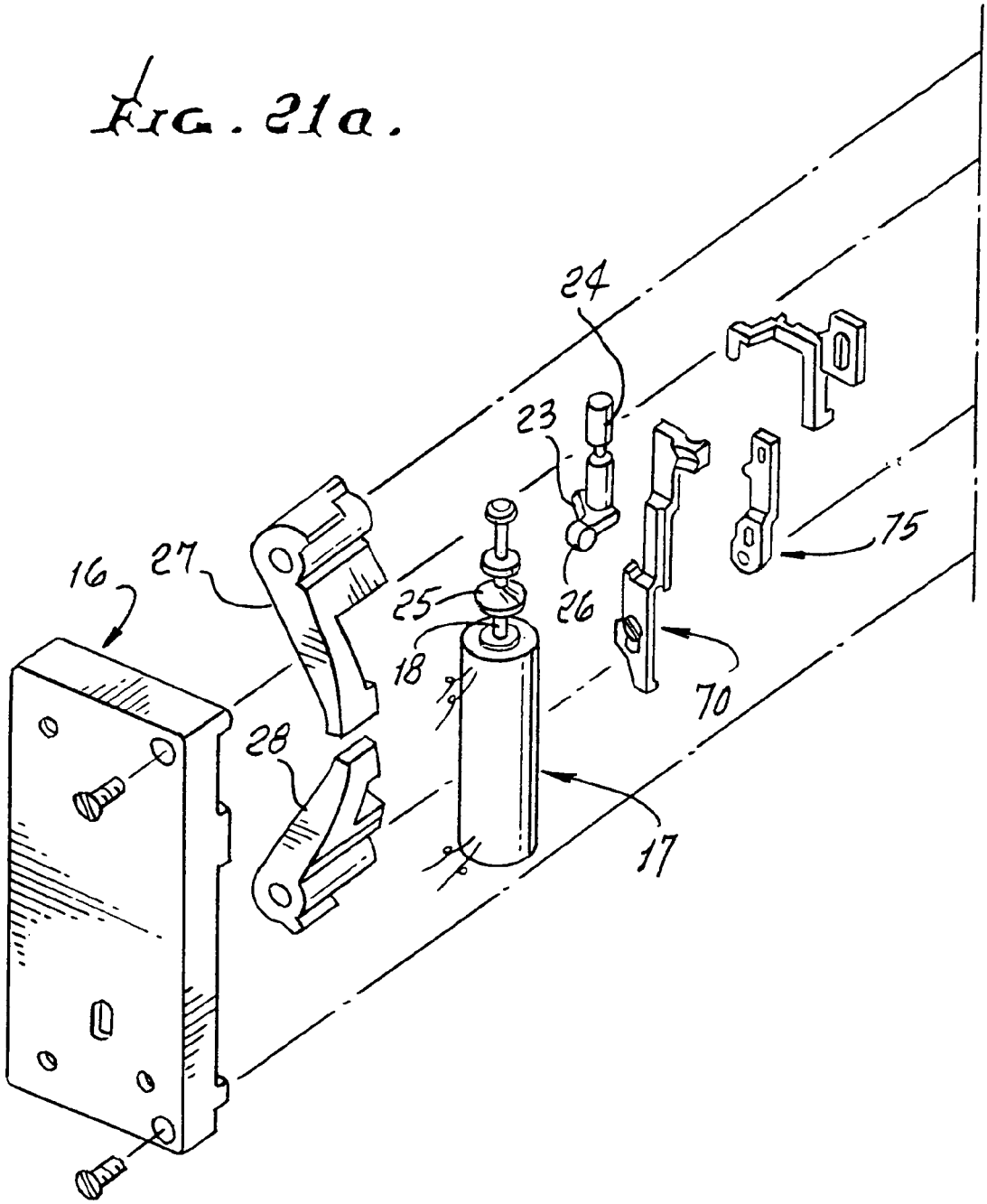
Figure 21B:
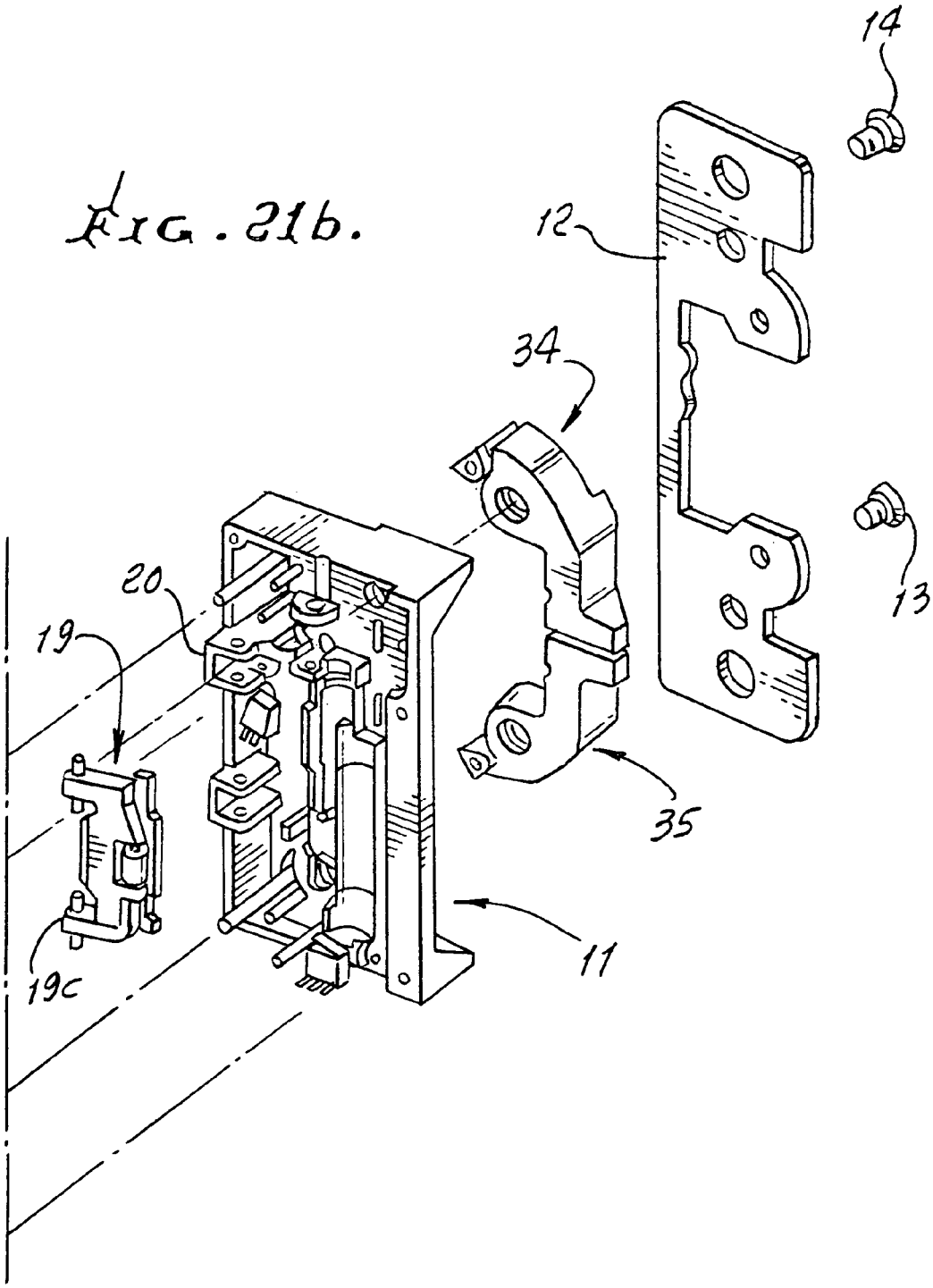
Figure 23:
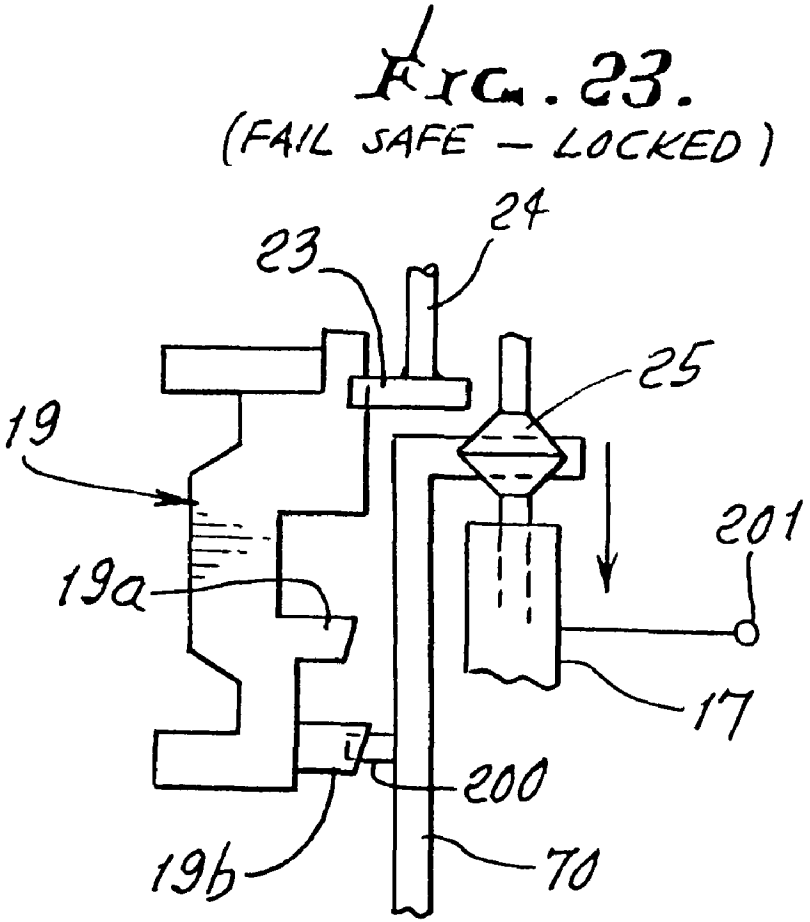
Figure 26:
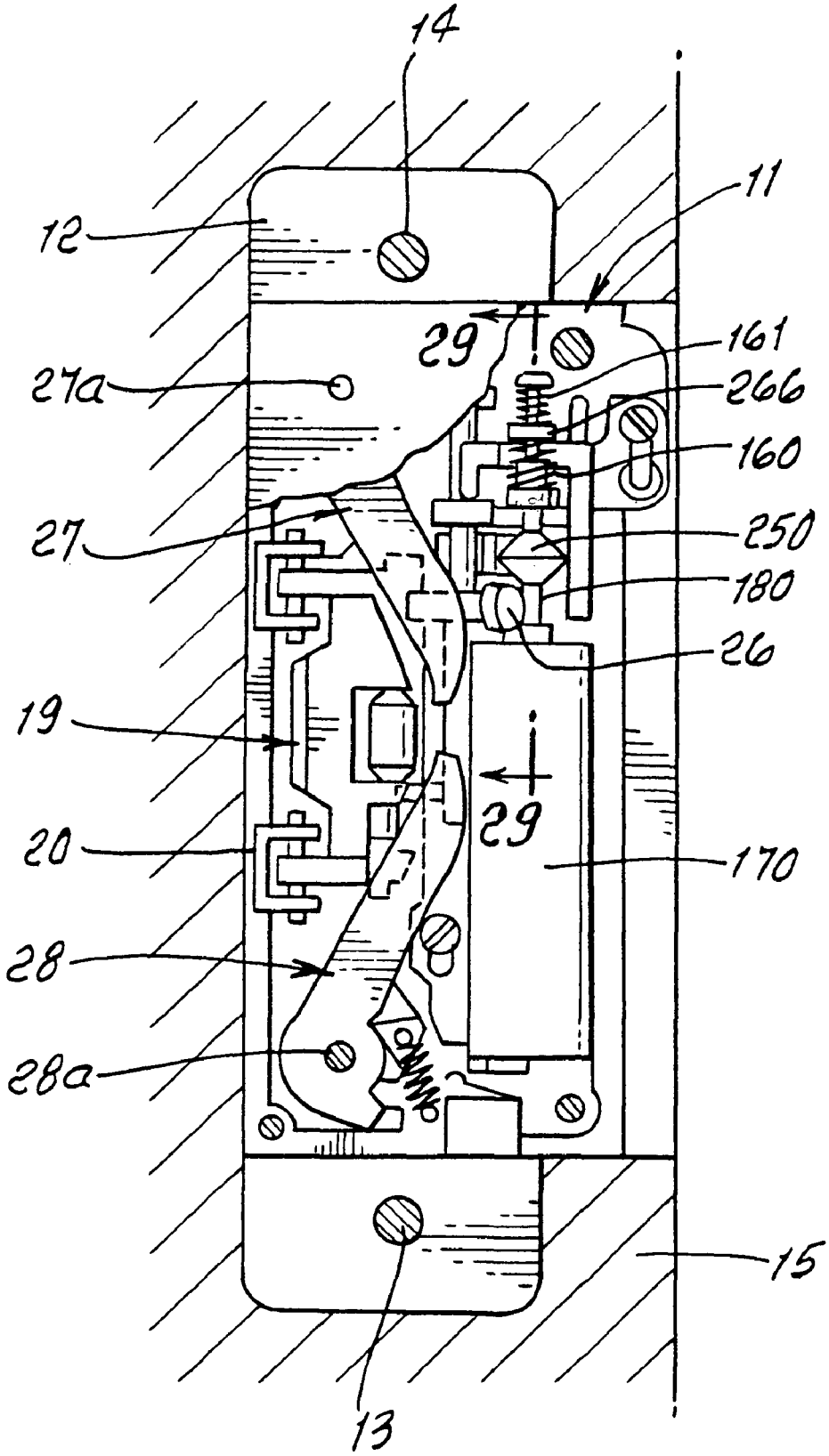
Figure 27:
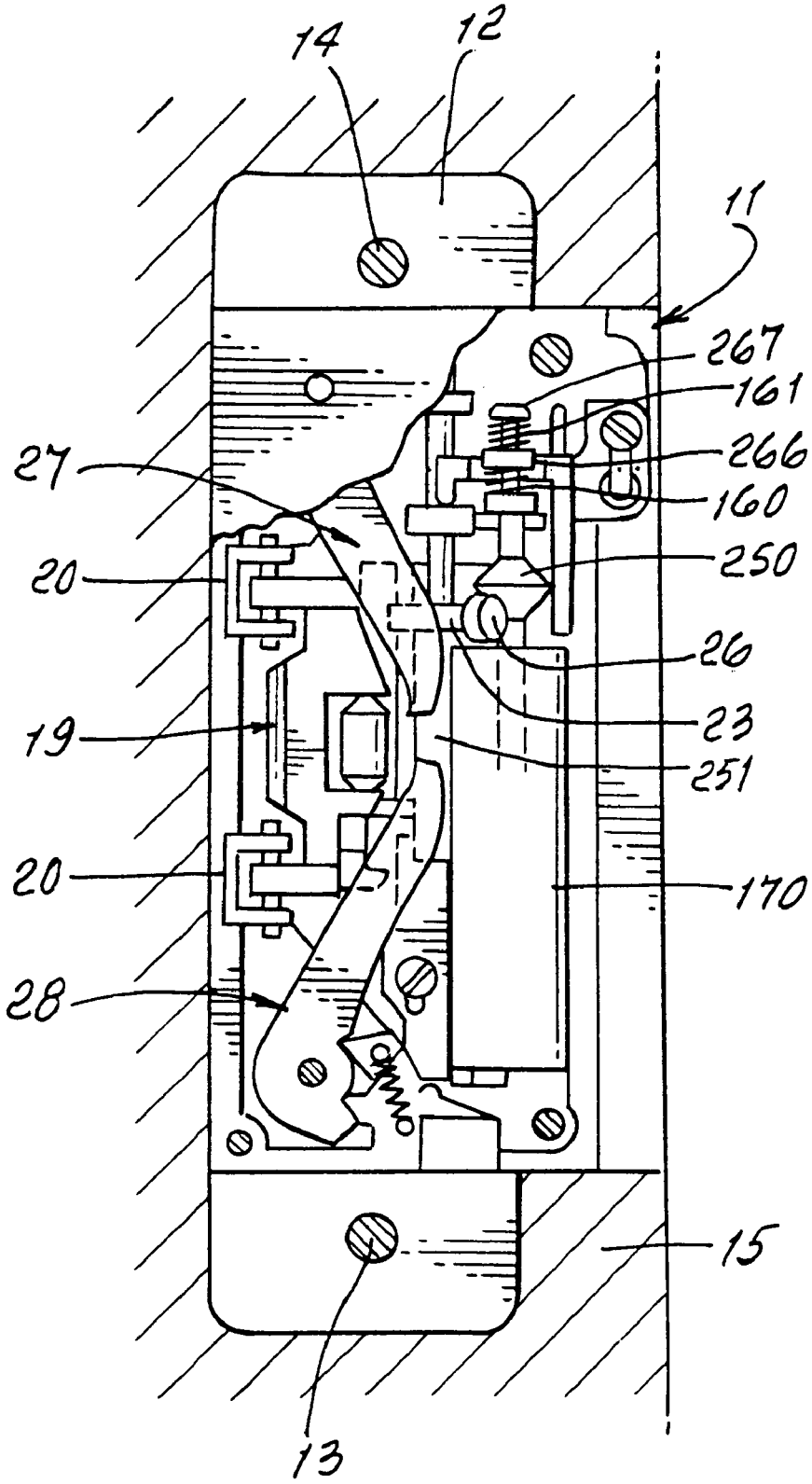
Figure 28:
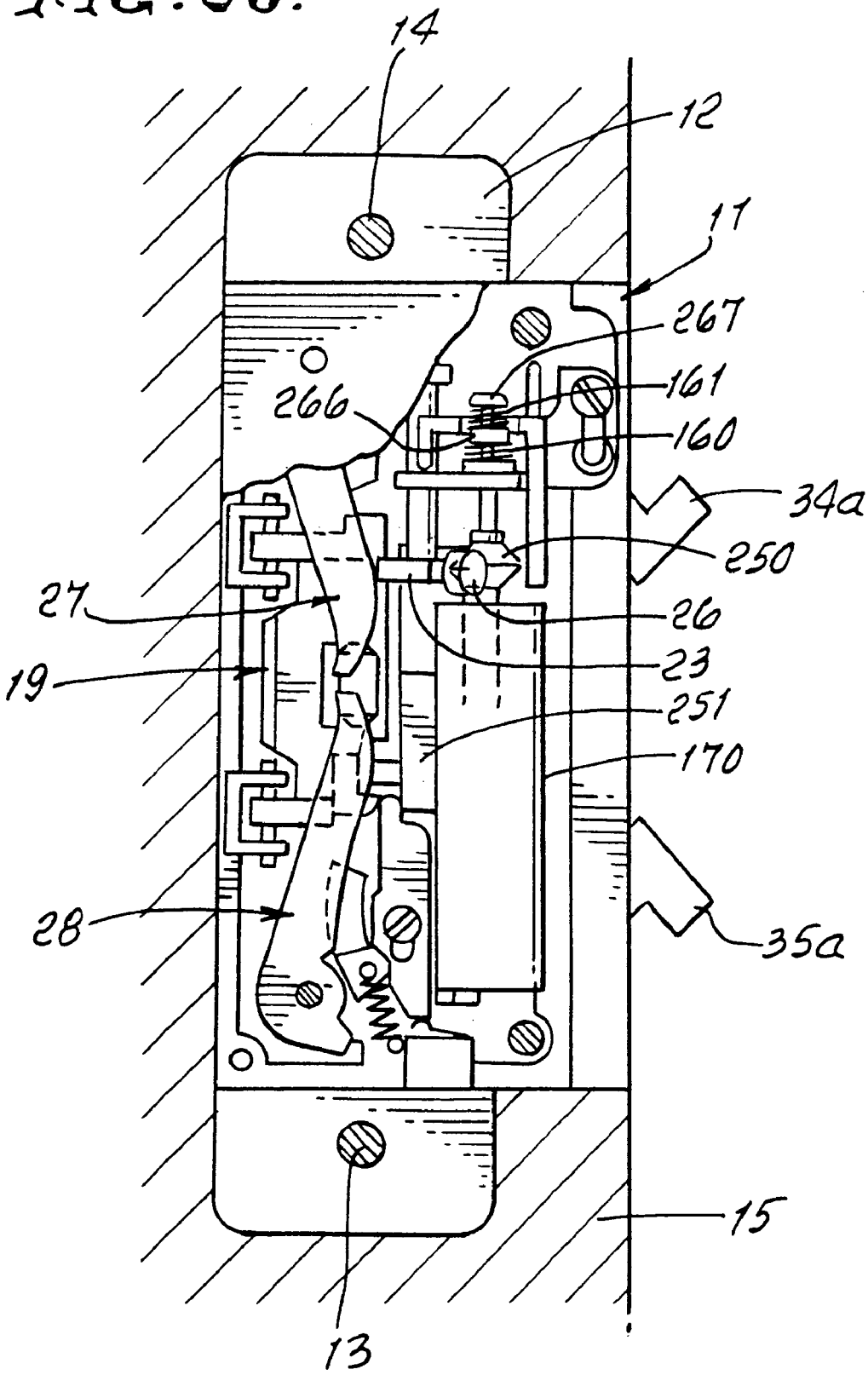
Figure 29:
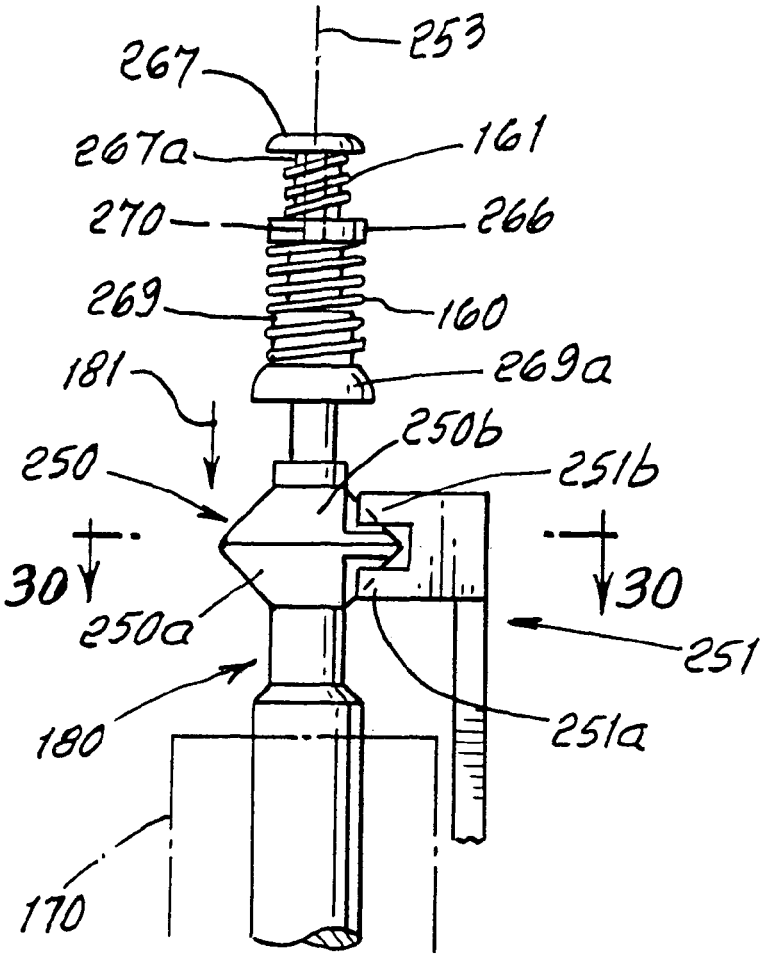
Figure 30:
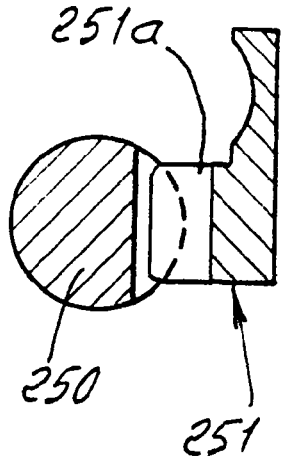
Figure 31:
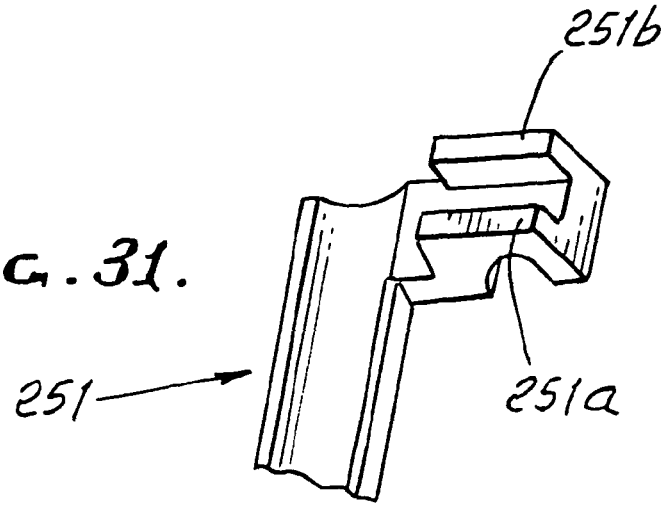

FIG. 9*a* is a view like FIG. 9, but showing solenoid plunger and cam effected rotary displacement of an actuating arm that rotatably displaces the trip lever to release the blocking arm or arms;

FIG. 10 is a view taken in section on lines 10-10 of FIG. 7, showing trip lever blocking of the blocking arm or arms;

FIG. 10*a* is a view like FIG. 10, but showing trip lever unblocking of a blocking arm;

FIG. 11 is a fragmentary side view of blocking arm blocking of swingable retainers for door bolt captivation;

FIG. 12 is a view like FIG. 11, showing swingably extended positions of the retainers, for door bolt release;

FIG. 13 is a fragmentary side view taken on lines 13-13—of FIG. 11; and FIG. 14 is a fragmentary section taken on lines 14-14—of FIG. 11;

FIG. 15 is a perspective view of a retainer;

FIG. 16 is a view like FIG. 6, but showing elements in fail safe mode;

FIG. 17 is a fragmentary view taken on lines 17-17 of FIG. 16;

FIG. 18 is a side view-taken on lines 18-18 of FIG. 17;

FIG. 19 is a perspective view of a link element, as also seen in FIG. 18;

FIG. 20 is a perspective view of a trap arm link as also seen in FIG. 18;

FIG. 21*a* is an exploded view of certain elements of the strike assembly, in a direction normal to the face plate;

FIG. 21*b* is an exploded view of remaining elements of the strike assembly;

FIGS. 22-25 are schematic views showing alternative modes of operation;

FIG. 26 is a view like FIG. 4, but showing a modification;

FIG. 27 is a view like FIG. 5, but also showing the modification of FIG. 26;

FIG. 28 is a view like FIG. 6, but also showing the modification of FIG. 26;

FIG. 29 is an enlarged view of plunger and spring apparatus;

FIG. 30 is a section taken on lines 30-30 of FIG. 29;

FIG. 31 is a perspective view of a modified link element; and

Figure 32:
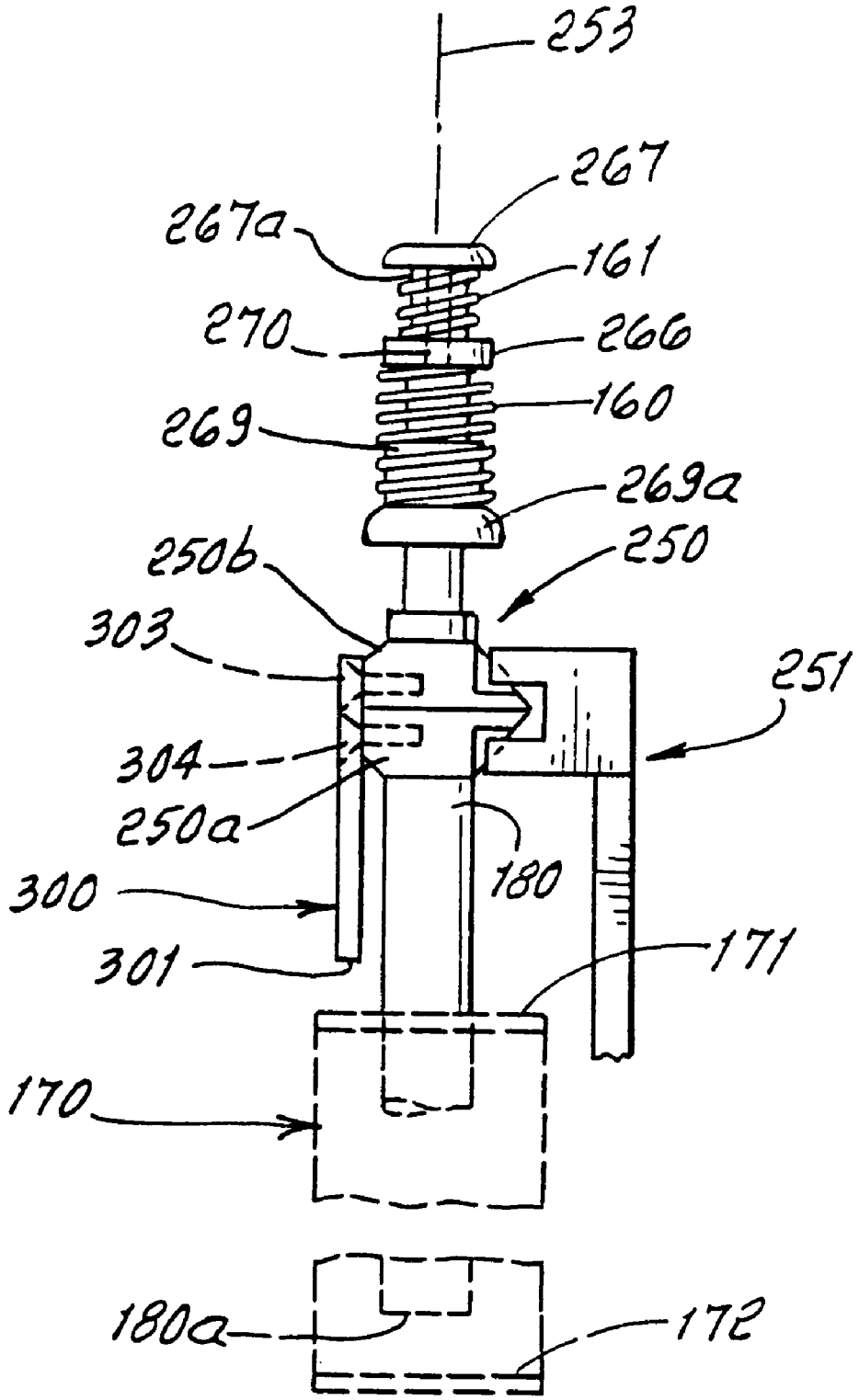

FIG. 32 is a perspective view of elements associated with two springs, in telescopically spaced relation.

DETAILED DESCRIPTION

Figure 1:
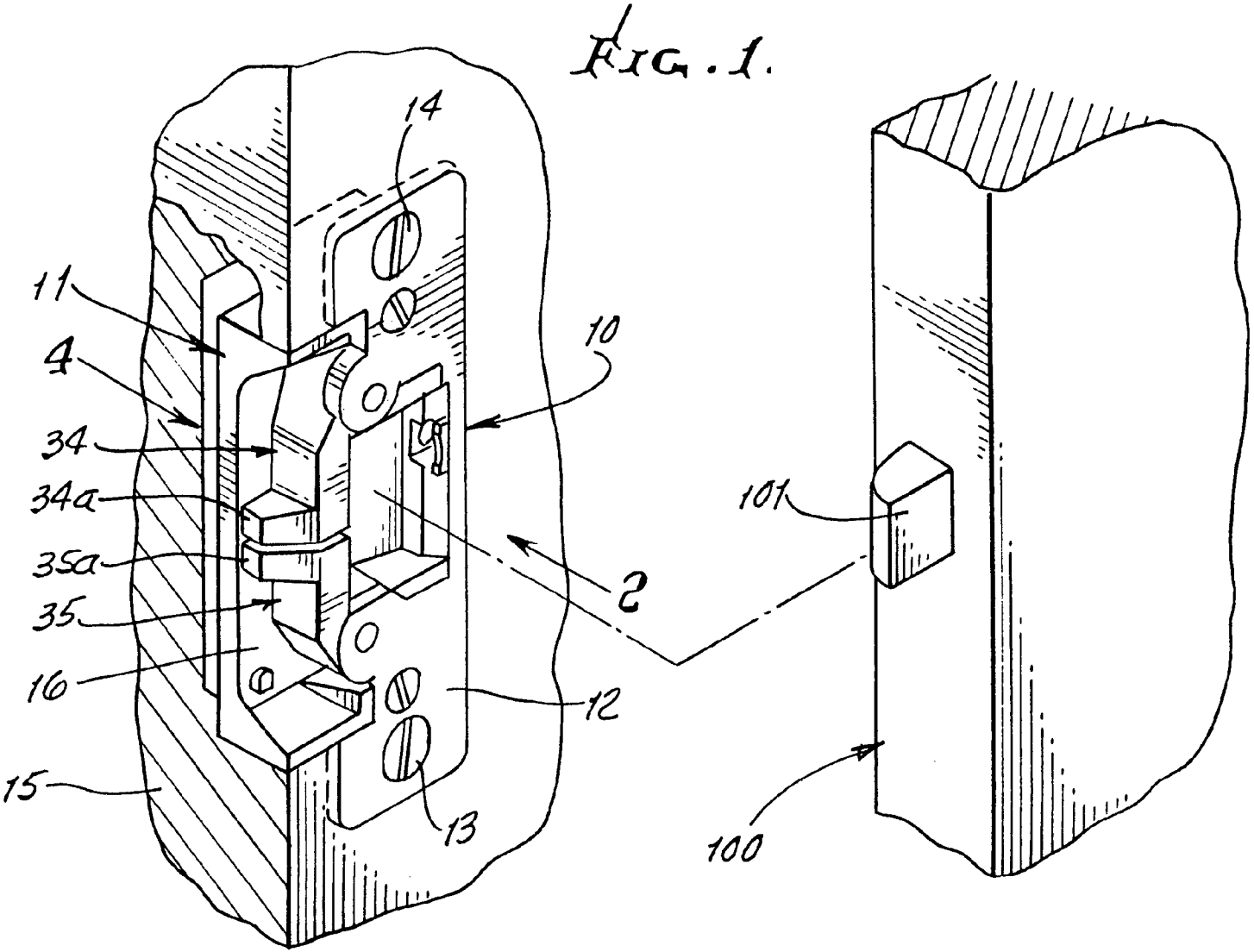
FIG. 1 is a perspective view of striker structure on a wall, as related to a door bolt.
Figure 3:
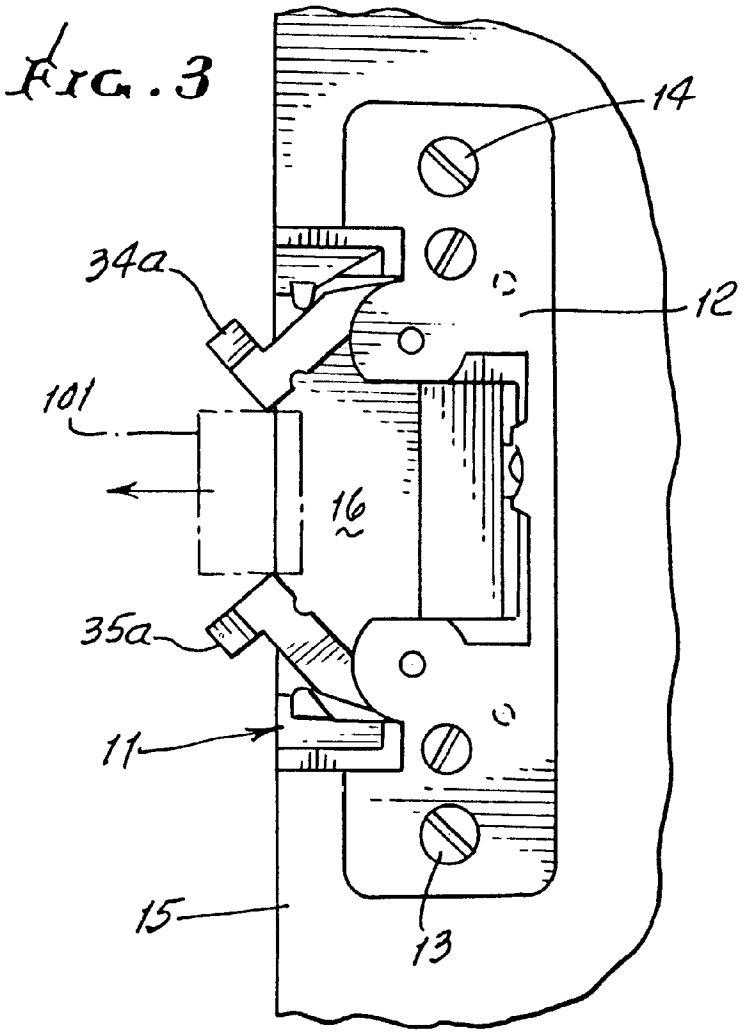
FIG. 3 is a view like FIG. 2, but showing extended positions of the retainers, for door bolt release.
Figure 2:
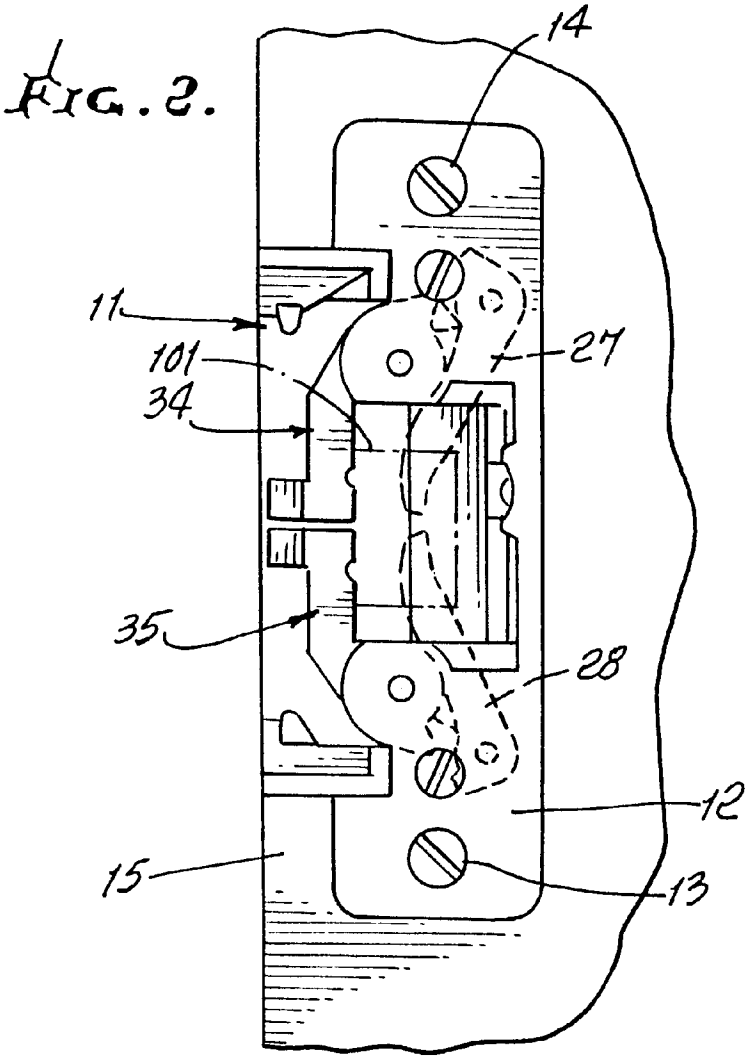
FIG. 2 is an outer side view of striker structure as viewed in arrow direction 2 indicated in FIG. 1; with retainers retracted form door bolt captivation.

In the drawings, showing a preferred embodiment, a door strike assembly 10 seen in FIG. 1 includes a carrier 11 having a face plate 12 attached by fasteners 13 and 14 to a door jamb 15. A cavity 16 in the longitudinally elongated carrier receives a longitudinally elongated solenoid 17 (see FIG. 4) having a cylindrical casing 17*a*. The solenoid includes a plunger 18 movable endwise for actuating elements of the assembly. Door 100 has a retractable bolt 101, and swings toward and away from the strike.

A trip lever 19 is pivotally supported in the assembly, and has legs 19*c* received on pivots 20, to swing about a longitudinal axis 21 as the lever is actuated. A laterally extending actuating arm 23 is pivotally supported at 24 in the cavity (see FIG. 9) to be cam pivoted (see FIG. 9*a*) as the plunger 18 moves axially longitudinally in response to solenoid operation, thereby to pivot the trip lever, as for example is shown in FIGS. 9 and 9*a*. See tapered cam 25 on the plunger bearing against a roller 26 on the arm 23, in FIGS. 5 and 9*a* to pivot arm 23, and thereby rotate the trip lever upwardly in FIG. 9*a*. The trip lever 19 is compactly located laterally of the solenoid 17 and the plunger 18, within the strike carrier cavity 16, as shown. Return spring 60 urges the plunger in a direction to displace cam 25 away from solenoid casing 17*a*.

Also included in the assembly is a blocking arm, and preferably two such arms, designated at 27 and 28, the arms extending generally longitudinally, and preferably longitudinally spaced apart. See arm pivots 27*a* and 28*a* longitudinally spaced apart, in FIGS. 11 and 12. The trip lever urges arms 27 and 28 directionally laterally rightwardly in FIG. 10 and generally toward the solenoid and plunger, in the compact relation as shown in FIGS. 4-7, and 10. Under this condition, the trip lever has the position as seen in FIGS. 9 and 10, blocking pivoting release of the arms 27 and 28. Such release is shown in FIGS. 10*a* and 12, whereby the blocking arms 27 and 28 pivot in generally lateral direction away from the solenoid and plunger, as shown by arrow 33. At that time, the trip lever 19 is pivoted upwardly as shown in FIGS. 9*a* and 10*a*, allowing lugs or terminals 34*a* and 35*a* on door bolt retainers 34 and 35 to swing generally rightwardly, as seen in FIG. 12, for releasing the door bolt, allowing door opening. The retainers are pivoted at 134 and 135. Note in FIG. 11 that projections 34*b* and 35*b* on the retainers are nested in recesses 27*b* and 28*b* in the arms 27 and 28, blocking pivoting of the door bolt retainers 34 and 35 rightwardly; and that when the blocking arms 27 and 28 are swung a small amount laterally leftwardly in FIG. 12, the recesses 27*b* and 28*b* are retracted away from the L-shaped terminals or projections 34*b* and 35*b*, releasing the retainers for swinging rightwardly as referred to. The door bolt can then push the terminals 34*a* and 35*a* relatively apart, to enable opening of the door. Thereafter springs 30 and 31 attached at 30*a* and 31*a* to 34 and 35, urge the latter back to FIG. 11 position so that projections 34*a* and 35*a* again nest in recesses 27*b* and 28*b*. This is a fail-safe condition of the elements, their pivoting as described being uninhibited.

FIGS. 4, 7, 16, 17 and 18 show operating structure or means associated with positioning of the solenoid plunger 18. A slider link 70 has proximal extent at 70*a*, adjacent the cam 25, and lateral extent 70*b*, to connect with the plunger 18, whereby the link is movable longitudinally with the plunger. Pins 71 and 72 on the link extend into slots 73 and 74 in a trip arm link 75, as seen in FIGS. 17-19. The elongated slots provide lost motion longitudinally operative connection of the pins to link 75.

The trip lever 19 has override registration or engagement with a tab 200 on the link 70 in one endwise position of 70, and disengagement with tab 200 in another endwise position of that link. Accordingly, the plunger 18 endwise positioning determines whether or not the trip lever can be pivotally deflected by arm 23 seen in FIG. 9. This provides a fail safe function of the assembly, in the event that electrical current energization of the solenoid (i.e. fail condition) is interrupted, spring 60 then acting to push the plunger down, to unblock the trip lever, so that retainers 34 and 35 can move as in FIG. 12, which allows the door to open.

As seen in FIGS. 11 and 12, the retainers 34 and 35 have convex stop surfaces at 34*d* and 35*d* to bear against the arms 27 and 28, in FIG. 11 position.

FIG. 6 shows provision of the longitudinally movable slider tab 200 on 70. As the slider tab is moved upwardly, it overlaps or registers with part 19*a* of the trip lever, preventing its pivoting deflection as in FIG. 24, thereby preventing unblocking of the arms 27 and 28, which prevents release of the retainers for pivoting. Terminals 34*a* and 35*a* cannot then be moved apart, as by door bolt pressure, to release that bolt for door opening movement, i.e. the door bolt remains captivated. This is a fail secure locked, power off condition or position of the mechanical elements.

SUMMARY

The invention makes it possible to embody in a single mechanism a capability for both "fail secure" door operation, and "fail safe" operation. Fail safe operation enables opening of a door from the inside of a room, for escape, despite a "power off" condition of a solenoid, as might result from malfunction. In "fail secure" condition, the door is normally locked, and energization of the solenoid is required to unlock the door, enabling door opening, for escape from the inside of the room.

Figure 22:
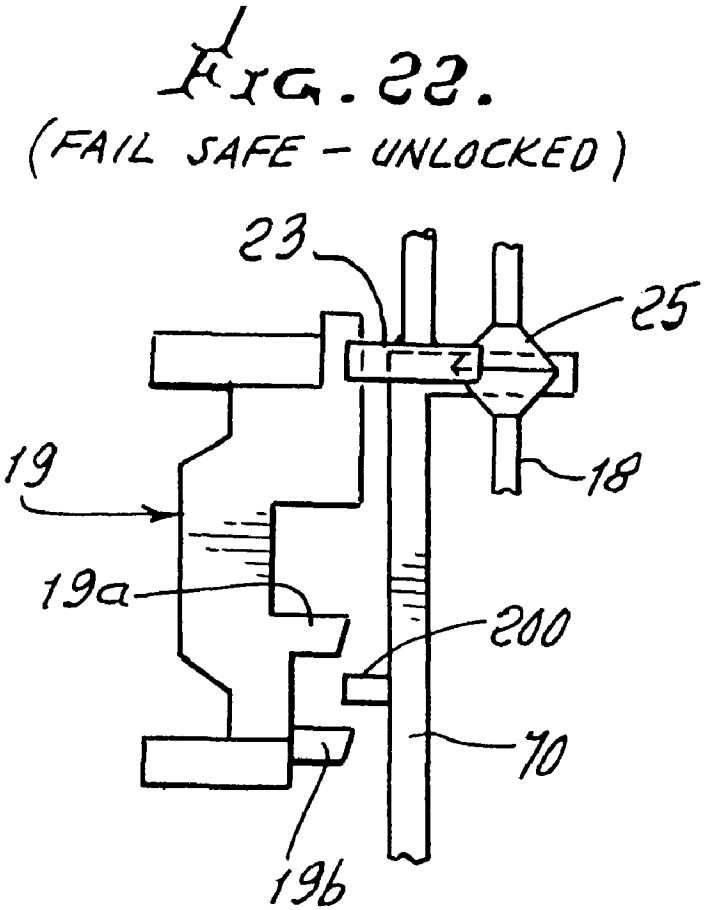

Refer first to FIG. 22 showing certain mechanism parts for operation in fail safe electrical power off mode. Slide link 70 is in a first position, with a tab 200 on it axially spaced from trip lever extents 19*a* and 19*b*. The trip lever is freely rotatable, so that the arms 27 and 28 are free to rotate so the door can open. Also, note that laterally extending arm 23 is at the upper side of cam 25 on the solenoid plunger 18. This is a power off condition. When electrical power is applied to the solenoid, and the solenoid shaft is retracted, as in FIG. 23, the tab 200 has been shifted axially to register with the trip arm and for tab rotation with link 70, to block rotation of the trip arm. This effects blocking of arms 27 and 28 and prevents door opening. When door opening is desired, a switch button 201 is pushed to cut off power to the solenoid, so that plunger 18 moves up, and tab 200 moves to FIG. 22 position.

Figure 25:
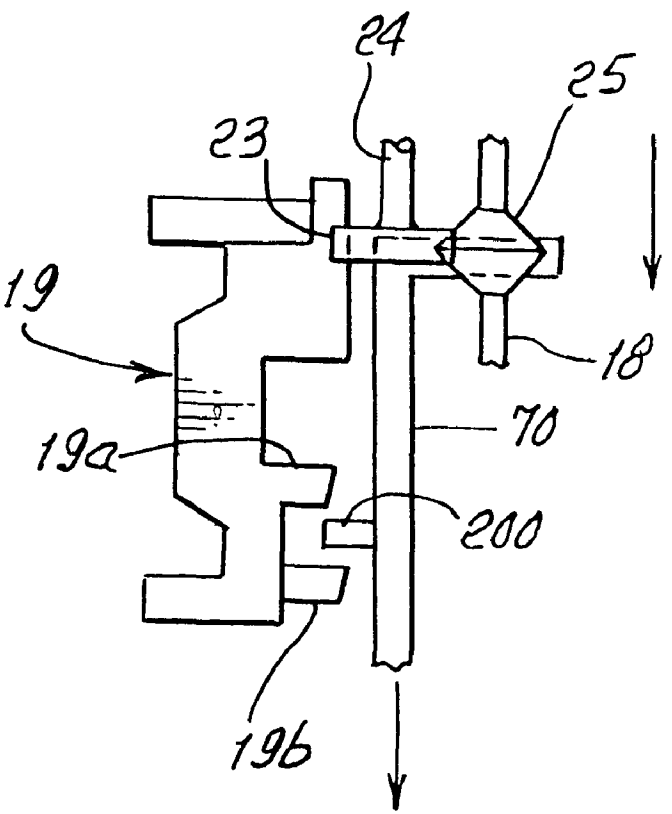
Figure 24:
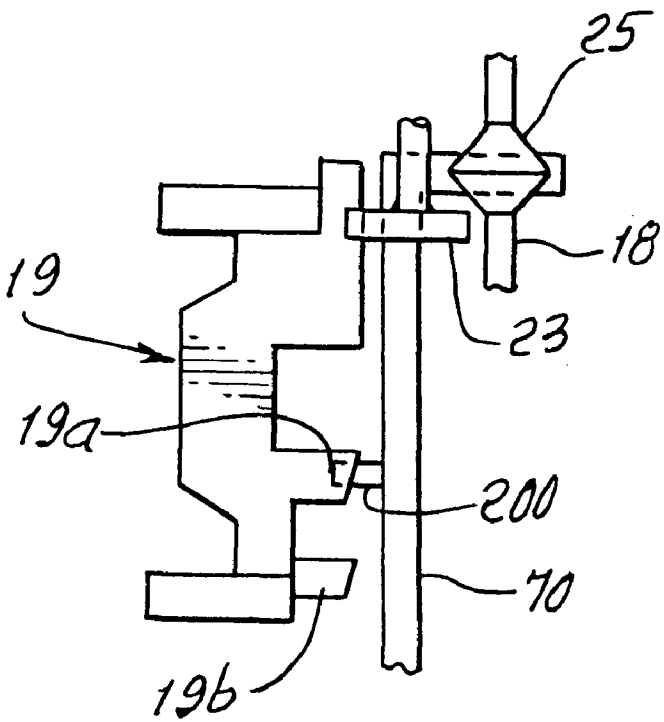

Refer next to FIGS. 24 and 25, corresponding to a fail secure adjustment of the apparatus, as may be desired by a customer. Fasteners 203 and 204 have been loosened, and carrier 70*a* shifted endwise and refastened by tightening of the fasteners 203 and 204 in FIG. 4 position as at the job site. This positions cam 25 at the opposite side of arm 23, with link 70 moved up and tab 200 registering with trip arm portion 19*a*, preventing trip arm rotation, and thereby block arms 27 and 28 against rotation. This is door locked position. When the cam is moved axially toward the solenoid (Power ON) in FIG. 25, the arm 23 is rotated by the cam to rotate link 70 and cause the tab 200 to rotate and move with link 70 to the position shown. This enables trip arm pivoting allowing arms 27 and 28 to rotate, allowing door opening. In other words, when current to the solenoid is interrupted (failed) the door is securely prevented from opening, and when current is applied to the solenoid, the door is allowed to open.

In FIGS. 24 and 25, power must be applied to the solenoid to enable door opening, and when no power is applied to the solenoid, the tab 200 blocks pivoting of the trip lever 19, as in FIG. 24, and the door is locked. FIG. 25 shows element positioning for door unlocked condition, i.e. slide link 70 has been pulled down by the solenoid plunger, so that tab 200 is now between 19*a* and 19*b*, allowing pivoting of 19.

Accordingly, only one highly compact apparatus is required for alternate adjustment to fail safe or fail secure operation.

Referring to FIGS. 26-31 showing a modification, which is preferred, elements which remain the same as in FIGS. 4-6 bear the same identification numbers.

In this modified form of the invention, solenoid 170 has an associated plunger 180 which is longitudinally movable. First and second spring elements 160 and 161 are located for sequentially resisting plunger axial movement, in a first longitudinal direction 181, whereby the first element and then the second element resist such plunger movement.

Door locking and unlocking mechanisms are operatively connected with the plunger as before, and such mechanism is shown to include a two sided cam 250 (corresponding to cam 25) on plunger 180, the cam having oppositely tapered sections 250*a* and 250*b* adapted to be bridged by arm sections 251*a* and 251*b* of link 251 to displace that link. The latter corresponds to link 70 shown in FIG. 19.

First coiled spring element 160 is preferably a lighter element than spring element 161, i.e. second spring element 161 has a higher spring rate than first spring element 160, the two being spaced apart longitudinally, i.e. in the direction of the plunger axis 253 of movement. The elements are positioned and activated such that as the plunger retracts toward the solenoid 170, element 160 is compressed first, (see FIG. 27) and element 161 is then compressed as the plunger continues its retracting stroke in response to solenoid energization. See FIG. 28. The effect of this is to forcibly ensure that the plunger will be quickly moved positively away from the solenoid to move link 251 with it, to FIG. 26 position, in response to solenoid de-energization. See FIG. 26.

Referring now also to FIGS. 29 and 32, pushers 266 and 267 are associated with the plunger to move therewith, and operable to first compress the first spring element 160 and subsequently to compress the second spring element 161 in response to said plunger movement.

Thus, pusher 266 is assembled to float between springs 160 and 161, so as to effect said initial compression of spring 160. Spring 160 fits on tubular spacer 269, and spring 161 fits on stem 267*a* of pusher 267.

Pusher 267 is assembled on plunger stem 270, so as to be retracted with 270 to compress heavier spring 161, after annular pusher 266 ends its axial compression of spring 160, which seats on flange 269*a* of 269. A set screw not shown retains 267 to plunger stem 270.

Referring now to FIG. 32 it shows a strut 300 carried to extend at the side of the solenoid plunger 180 for axial endwise movement with the plunger. Upon plunger retraction, the end 301 of the strut engages solenoid structure, such as housing end surface 171, to limit such retraction. This prevents wear such as peening of the plunger end 180*a* which would otherwise strike or impact solenoid interior surface 172 upon plunger retraction; interfering with plunger operation over extended periods of time or use.

As shown, the strut is connected, as by fasteners 303 and 304 to cam 250, sidewardly of the cam two oppositely axially tapered surfaces 250*a* and 250*b*. Such connections to the cam stabilize the strut for such use over extended cycles of plunger retraction.

I claim:

1. In a door strike for captivating and releasing a door bolt, the combination comprising a) a longitudinally elongated carrier, b) mechanism including a longitudinally elongated solenoid supported by the carrier, the solenoid having a longitudinally movable plunger, c) a trip lever pivotally supported in the carrier, d) a laterally extending actuating arm pivotally supported in the carrier to be pivoted by a tapered cam surface as the plunger moves longitudinally in response to solenoid energization, thereby to pivot the trip lever, e) a generally longitudinally extending blocking arm or arms pivotally supported in the carrier to be released for pivoting when the trip lever is pivoted, and f) a door bolt retainer or retainers pivotally supported in the carrier to be released for pivoting when the blocking arm or arms are released for pivoting, thereby to release the door bolt from captivation, for movement with the door, g) said mechanism having an adjusted fail secure first configuration characterized in that when electrical power to the solenoid is OFF, the mechanism is locked, preventing release of the door bolt for door opening, h) said mechanism having an adjusted fail safe second configuration characterized in that when electrical power to the solenoid is ON, the mechanism is locked, and when electrical power to the solenoid is OFF, the mechanism is unlocked, releasing the door bolt for door opening, i) there being two of said retainers which have L-shaped door bolt captivating terminals that spread apart as the two retainers pivot, j) and wherein said mechanism includes a slide link and a tab on said link movable by the link between a first position registered with the trip lever and effecting blocking thereof, and corresponding to said first configuration, and a second position wherein the tab is not registered with the trip lever and corresponding to said second configuration.

2. The combination of claim 1 wherein the trip lever, actuating arm, blocking arm or arms, and retainer or retainers have one of the following:

i) fail safe positioning in which the blocking arm or arms is or are unblocked in the event electric power supply to the solenoid is interrupted, ii) fail secure positioning in which the blocking arm or arms remain blocked by the trip lever, against pivoting, while power supply to the solenoid remains interrupted.

3. The combination of claim 2 including an adjustable slider movable longitudinally and having operative engagement with the trip lever of claim 1 to provide said fail safe positioning in one longitudinal position of said slider and alternatively to provide said fail secure positioning in another longitudinal position of said slider.

4. The combination of claim 3 wherein said slider also has operative connection with the plunger, to be endwise positioned by a plunger return spring in the event of failure of electrical operation of the plunger.

5. The combination of claim 1 wherein the retainer or retainers have interengagement with the blocking arm or arms characterized as releasable when the blocking arm or arms pivot in one direction as the retainer or retainers pivot in the opposite direction.

6. The combination of claim 1 wherein said actuating arm and plunger have operative camming interengagement.

7. The combination of claim 6 including a return spring acting to displace the plunger in a direction away from said camming interengagement.

8. The combination of claim 1 wherein said trip lever and at least one of the blocking arms extend laterally of and adjacent to the solenoid.

9. The combination of claim 1 including a wall face plate associated with said carrier.

10. The combination of claim 1 wherein the solenoid has a plunger, and said slide link is operatively connected with the plunger to move therewith.

11. The combination of claim 10 including a cam operatively connected with the plunger, and a pivoted arm operatively connected with the slide link for pivoting said link in response to cam engagement with the arm.

12. In a door strike for captivating and releasing a door bolt, the combination comprising a) a longitudinally elongated carrier, b) mechanism including a longitudinally elongated solenoid supported by the carrier, the solenoid having a longitudinally movable plunger, c) a trip lever pivotally supported in the carrier, d) a laterally extending actuating arm pivotally supported in the carrier to be pivoted by a tapered cam surface as the plunger moves longitudinally in response to solenoid energization, thereby to pivot the trip lever, e) a generally longitudinally extending blocking arm or arms pivotally supported in the carrier to be released for pivoting when the trip lever is pivoted, and f) a door bolt retainer or retainers pivotally supported in the carrier to be released for pivoting when the blocking arm or arms are released for pivoting, thereby to release the door bolt from captivation, for movement with the door, g) said mechanism having an adjusted fail secure first configuration characterized in that when electrical power to the solenoid is OFF, the mechanism is locked, preventing release of the door bolt for door opening, h) said mechanism having an adjusted fail safe second configuration characterized in that when electrical power to the solenoid is ON, the mechanism is locked, and when electrical power to the solenoid is OFF, the mechanism is unlocked, releasing the door bolt for door opening, there being slider and tab structure movable by the solenoid to block and unblock trip lever pivoting, i) there being two of said blocking arms spaced apart longitudinally, one blocking arm located laterally of a casing defined by the solenoid, to pivot away from that casing, the other blocking arm located laterally of said plunger, to pivot away from the plunger.

13. In a door strike for captivating and releasing a door bolt, the combination comprising a) a longitudinally elongated carrier, b) mechanism including a longitudinally elongated solenoid supported by the carrier, the solenoid having a longitudinally movable plunger, c) a trip lever pivotally supported in or on the carrier, d) a laterally extending actuating arm pivotally supported in or on the carrier to be pivoted as the plunger moves longitudinally in response to solenoid energization, thereby to pivot the trip lever, e) a generally longitudinally extending blocking arm or arms pivotally supported in or on the carrier to be released for pivoting when the trip lever is pivoted, and f) a door bolt retainer or retainers pivotally supported in or on the carrier to be released for pivoting when the blocking arm or arms are released for pivoting, thereby to release the door bolt from captivation, for movement with the door, g) said mechanism having an adjusted fail secure first configuration characterized in that when electrical power to the solenoid is OFF, the mechanism is locked, preventing release of the door bolt for door opening, h) said mechanism having an adjusted fail safe second configuration characterized in that when electrical power to the solenoid is ON, the mechanism is locked, and when electrical power to the solenoid is OFF, the mechanism is unlocked, releasing the door bolt for door opening, there being slider and tab structure movable by the solenoid to block and unblock trip lever pivoting, i) and wherein there are first and second spring elements having positions for sequentially resisting plunger axial movement, in a first longitudinal direction, whereby the first element and the second element resist said plunger movement, said spring elements spaced apart longitudinally in the direction of plunger movement.

14. The combination of claim 13 wherein the second spring element has a higher spring rate than the first spring element.

15. The combination of claim 13 wherein said spring elements have coil configuration and are spaced apart longitudinally.

16. The combination of claim 13 including pushers associated with the plunger to move therewith, and operable to first compress the first spring element and subsequently to compress the second spring element in response to said plunger movement.

17. The combination of claim 16 wherein the first spring element is located between the second spring element and the solenoid.

18. The combination of claim 16 wherein the second spring element is located, when compressed, to positively and rapidly urge the plunger in a second longitudinal direction opposite said first longitudinal direction when the solenoid is de-energized.

19. The combination of claim 16 including a strut carried to extend at the side of the plunger for movement therewith, to engage solenoid structure in response to plunger retraction, for limiting said retraction.

20. The combination of claim 13 including a cam located by the plunger to engage an element of said mechanism in response to plunger movement to compress said spring elements.

21. The combination of claim 20 including a strut operatively connected to the plunger adjacent said cam to extend at the side of the plunger for movement therewith, to engage solenoid structure in response to plunger retraction, for limiting said retraction.

22. The combination of claim 21 wherein said cam has two oppositely and axially tapered surfaces, said strut connected to the cam to extend adjacent said surfaces.

* * * * *